US006848594B2

(12) United States Patent
Holland

(10) Patent No.: US 6,848,594 B2
(45) Date of Patent: Feb. 1, 2005

(54) PRE-MOISTENED WIPE DISPENSER AND PRODUCT IDENTIFICATION SYSTEM

(75) Inventor: Brian T. Holland, Chicago, IL (US)

(73) Assignee: JohnsonDiversey, Inc., Sturtevant, WI (US)

( * ) Notice: Subject to any disclaimer, the term of this patent is extended or adjusted under 35 U.S.C. 154(b) by 160 days.

(21) Appl. No.: 10/065,978

(22) Filed: Dec. 5, 2002

(65) Prior Publication Data

US 2004/0108324 A1 Jun. 10, 2004

(51) Int. Cl.[7] ..... A47K 10/24
(52) U.S. Cl. ..... 221/46; 206/210
(58) Field of Search ..... 221/33, 46, 63, 221/48; 206/210, 205, 409, 812, 494; 225/106

(56) References Cited

U.S. PATENT DOCUMENTS

| | | | | |
|---|---|---|---|---|
| 3,986,479 A | * 10/1976 | Bonk | | 118/506 |
| 4,180,160 A | 12/1979 | Ogawa et al. | | 206/210 |
| 4,535,912 A | 8/1985 | Bonk | | 221/46 |
| 5,320,772 A | 6/1994 | Tricca | | 252/160 |
| 5,577,634 A | 11/1996 | Morand | | 221/43 |
| 5,765,718 A | 6/1998 | Grasso et al. | | 221/62 |
| 5,857,642 A | 1/1999 | Zinnbauer | | 221/63 |
| 6,158,614 A | 12/2000 | Haines et al. | | 242/593 |
| 6,182,858 B1 | 2/2001 | Hartog | | 221/63 |
| 6,213,424 B1 | 4/2001 | Helfer-Grand | | 242/564.1 |
| 6,328,252 B1 | 12/2001 | Neveu et al. | | 242/593 |
| 6,394,324 B1 | 5/2002 | Chen | | 222/561 |

FOREIGN PATENT DOCUMENTS

| | | | |
|---|---|---|---|
| WO | WO 02/41742 A1 | 5/2002 | 10/38 |

* cited by examiner

*Primary Examiner*—Kenneth Noland
(74) *Attorney, Agent, or Firm*—Neil E. Hamilton; Warren R. Bovee; Renee J. Rymarz

(57) ABSTRACT

An apparatus for the dispensing of wipes and a color coding system for use said apparatus for identifying the product on the wipes. The dispenser includes a housing, a two sectioned tip member, a well, an opening, a cover and a self closing mechanism. The wipe packs of the present invention further includes a pin member that is inserted in the center of the wipes and engages the wipes with the protrusions extending down the pin members shaft.

25 Claims, 5 Drawing Sheets

PRE-MOISTENED WIPE DISPENSER AND PRODUCT IDENTIFICATION SYSTEM

BACKGROUND OF INVENTION

Technical Field

This invention relates generally to a dispenser used in conjunction with pre-moistened wipes that contain a variety of cleaning solutions or compounds that allows for quick and easy access to the wipes while preventing the wipes from drying out. Further, it relates to a system where a dispenser can be used with pre-moistened wipes with a variety of solutions contained on the wipes in which various colors identify the various products and the variation can be seen by the end user to identify which dispenser contains the desired product.

The use of pre-moistened wipes has considerable advantages in the cleaning and sanitizing area but also has some considerable draw backs. For example the pre-moistened wipes must be contained in a sealed container or they will dry out. This problem has been addressed in a variety of ways but they involve methods of containing the wipes in which they require multiple steps to retrieve the wipes and reseal the dispenser. Additionally there is the problem of identifying the product contained on the wipes. This is a particular problem with respect to the industrial and institutional area where many different products are stored and in use at the same time.

U.S. Pat. Nos. 5,577,634, 5,765,718, 5,857,642 and 6,328,252 discloses a dispenser with quick and easy access to paper toweling but lack the seal necessary to protect pre-moistened wipes from drying out. They are specifically designed only for use with dry paper toweling.

U.S. Pat. Nos. 4,180,160 and 5,320,772 show various types of pre-moistened wipe dispensers that incorporate a diaphragm type opening such as 5 and 7 respectively, with a secondary cap that needs to be manually opened and closed 7 and 9 respectively.

U.S. Pat. Nos. 6,158,614, 6,182,858 and 6,394,324 show various types of pre-moistened wipe dispensers with varied openings to remove the pre-moistened wipes from but they still have the secondary cover which is manually opened and closed.

The aforementioned patents do not provide an apparatus for the dispensing of pre-moistened wipes with an automatically closing cap which seals and prevents the drying out of the pre-moistened wipes. Also the openings of the dispensers in the aforementioned patents are of a nature that causes the wipes to rip as they pass through the opening. The current invention provides an opening that will allow the wipes to be removed without tearing but still prevents the pulling of multiple sheets at one time. Further none of the dispensers in the patents listed above provide for a starter pin to start the wipes through the opening or a color coding system to identify the product contained within the dispenser. The fact is that the dispensers in the listed patents are meant for a single use then they are to be discarded. They do not anticipate the use of refill packs or varying products for each dispenser.

The objects of the invention therefore are:Providing an improved dispensing apparatus for pre-moistened wipes.

Providing a dispensing apparatus which affords the use of a color coding system to identify the product contained within the dispenser.

Providing a dispensing apparatus which provides for an efficient way to feed the wipe in a refill pack into the dispenser tip for use.

Providing a dispensing apparatus which allows for the removal of individual wipes without the damage to the wipes from the opening.

Providing a dispensing apparatus of the foregoing type which is attachable to a fixed surface, or mobile and attachable to an individual's belt or waistband.

SUMMARY OF INVENTION

The foregoing objects are accomplished and the shortcomings of the prior art are overcome by the apparatus of this invention which in one embodiment dispenses pre-moistened wipes. The apparatus includes a housing and a two sectioned tip member. The housing has a translucent section to allow for the identification of the product in use. The tip member is in two sections. The lower section is attached to the housing in a non-removable manner while the upper section is attached to the lower section through an external hinge where the upper section can be lifted to expose the well and the opening into the housing allowing for the replacement of the re-fill packs of the pre-moistened wipes. The upper section also has a cap that is connected to a self closing mechanism which when opened exposes the opening from which the pre-moistened wipes are dispensed. There is a product chamber with a product conduit interconnecting the mixing chamber and the product chamber. Once the cap is released the self-closing mechanism closes the cap producing a seal to prevent the pre-moistened wipes from drying out.

In a preferred embodiment, the entire housing is constructed of a translucent material.

In another preferred embodiment, the opening of the tip member is in an essentially circular form with at least one protrusion extending from the side of the opening towards the center of the opening.

In one aspect, the self-closing mechanism is comprised of an extension on the cap and an extension on the upper portion of the tip member with a spring connecting the two extensions.

In another aspect, the pre-moistened wipe packs contain a color element that correlates to the product that is contained within the packs which is visible through the translucent section of the housing allowing for the easy identification of the product by the end user.

These and still other objects and advantages of the invention will be apparent from the description which follows. In the detailed description below a preferred embodiment of the invention will be described in reference to the full scope of the invention. Rather, the invention may be employed in other embodiments.

DETAILED DESCRIPTION

Figure 1:
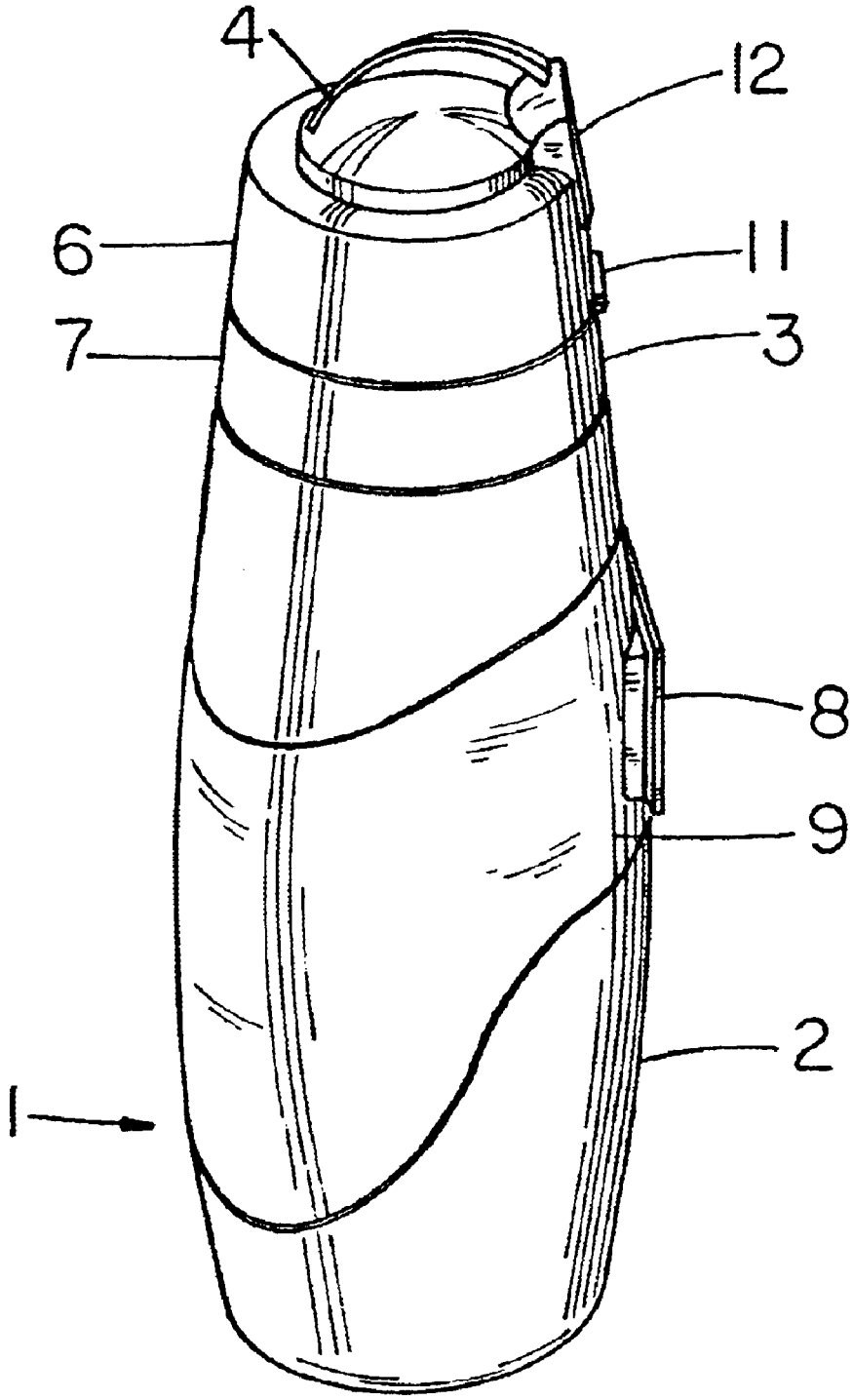
FIG. 1 is a front perspective view of the apparatus of this invention.

Referring to FIG. 1 the apparatus generally 1 for dispensing pre-moistened wipes 27 (see FIG. 7) includes a housing 2 and a two sectioned tip member 3 made up of an upper section 6 and a lower section 7. The upper section 6 has a cover 4, an opening 22 (see FIG. 10) and a self closing mechanism 12. The upper and lower sections are attached to each other with a hinge member 11 allowing for the opening and closing of the upper section 6 and the lower section 7.

Figure 9:
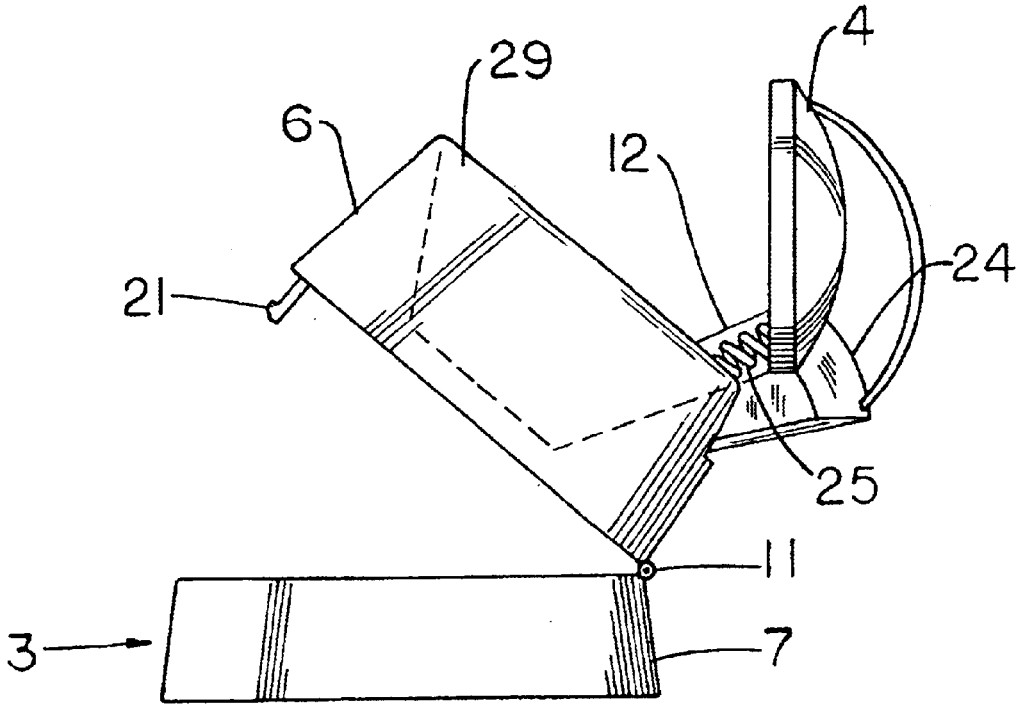
FIG. 9 is a side view of the tip member with the cap and the upper section opened and the well in phantom.

As seen in FIG. 9 the upper section 6 and the lower section 7 of the tip member 3 further have a locking mechanism 21 that retains the two sections together during the use of the dispenser 1. The well 29 of the upper section 6 of the tip member 3 is also shown in phantom. In the preferred embodiment the opening 22 is located at the bottom of the well 29 and the cover 4 is located at the top of the well 29. The use of the well 29 allows for a portion of the wipes 27 to be exposed for easy dispensing while the use of the self closing mechanism 12 and the cover 4 protect the wipe 27 from drying out.

The lower section 7 of the tip member 3 of the dispenser 1 is engaged with the housing 2 in a non-removable manner. The self closing mechanism 12 of the dispenser 1 is attached to both the cover 4 of the upper section 6 of the tip member 3 and the lower section 7. The self closing mechanism 12 includes an arm member 24 which is attached to the cover 4 of the upper section 6 of the tip member 3, an attachment member 26 which is attached to the lower section 7 of the tip member 3 and a spring member 25 which is connected to the arm member 24 and the attachment member 26.

Figure 2:
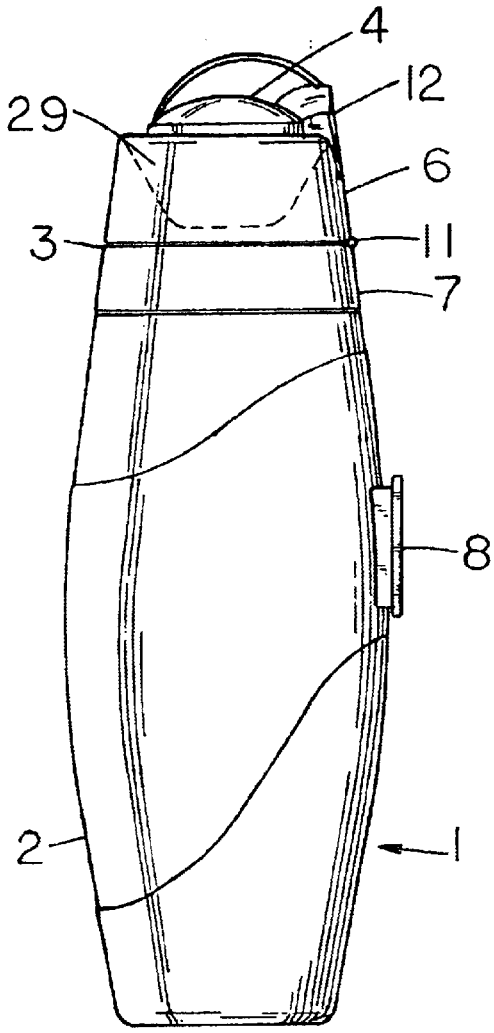
FIG. 2 is side view of the apparatus of this invention with the well in phantom.
Figure 3:
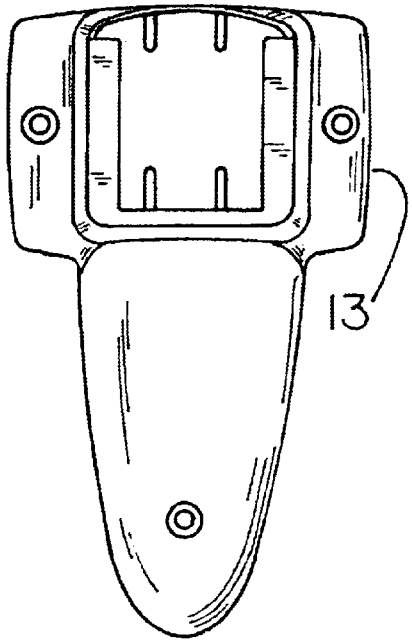
FIG. 3 is a front view of the bracket to attach the apparatus to a fixed surface.
Figure 4:
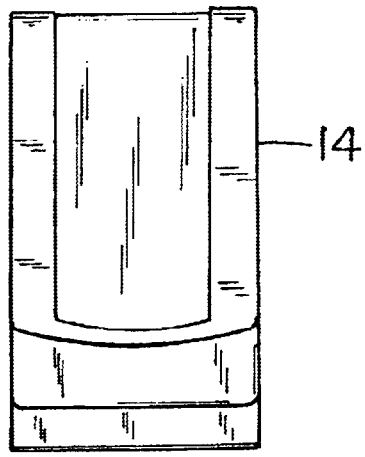
FIG. 4 is a front view of the clip to attach the apparatus to a belt or waist band.
Figure 5:
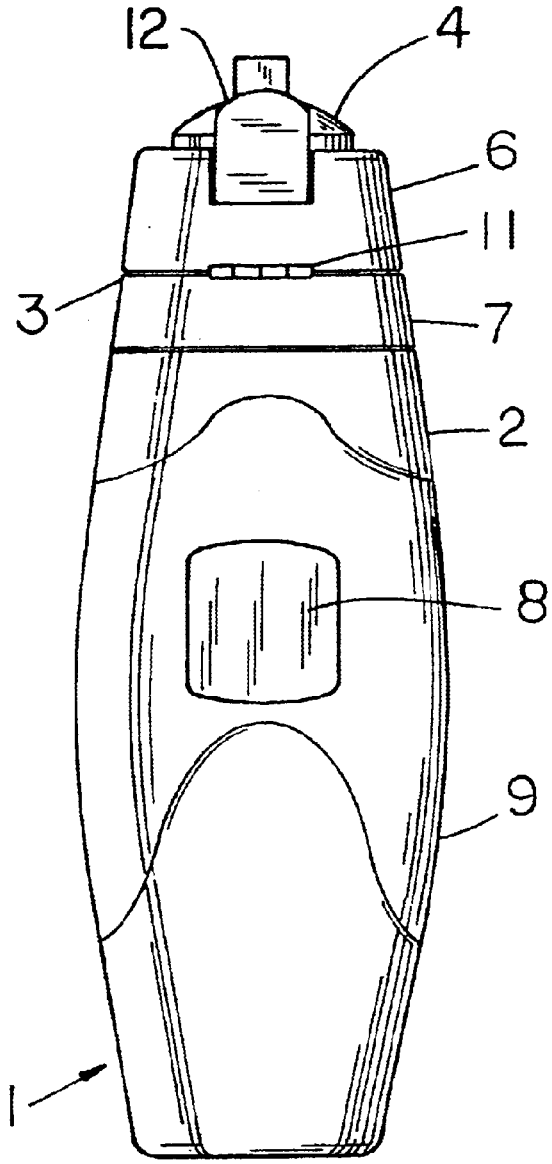
FIG. 5 is back view of the apparatus of this invention.

Referring to FIGS. 5, 2 and 3 the housing 2 of the dispenser 1 has an connecting member 8 for use in conjunction with a bracket 13 in order to secure the dispenser 1 to a fixed surface or the connecting member 8 may be used in conjunction with a clip 14 which allows the dispenser 1 to be secured to an individuals belt or waist band for a more mobile use.

The housing 2 of the dispenser 1 has a transparent portion 9 which is constructed of a transparent material exposing the pre-moistened wipe pack 20 when it is engaged in the dispenser 1. In another embodiment, the entire housing 2 of the dispenser 1 may be constructed of transparent material which will expose the entire pre-moistened wipe pack 20 when it is fully engaged in the dispenser 1.

Figure 10:
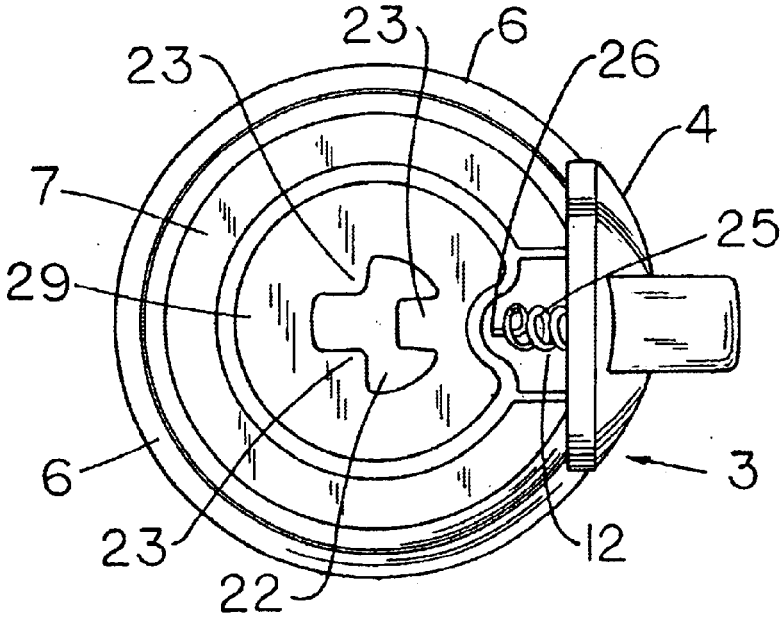
FIG. 10 is a top view of the tip member with the cap opened showing an opening.

Referring to FIG. 10 the opening 22 in the upper section 6 of the tip member 3 is essentially circular in nature but it has protrusions 23 that extend from the side of the opening 22 towards the center of the opening 22. The preferred embodiment has three protrusions 23 that are spaced to maximize the protrusions 23 ability to, separate the wipe being removed from the next wipe 27 so as to dispense one wipe 27 at a time while not ripping or damaging the wipes 27 when removed from the dispenser 1.

Figure 7:
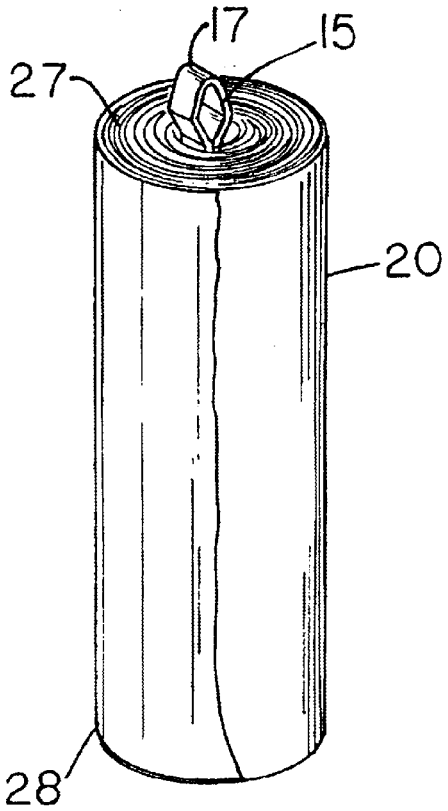
FIG. 7 is a front perspective view of the pre-moistened wipe packs with the starter pin fully engaged.
Figure 8:
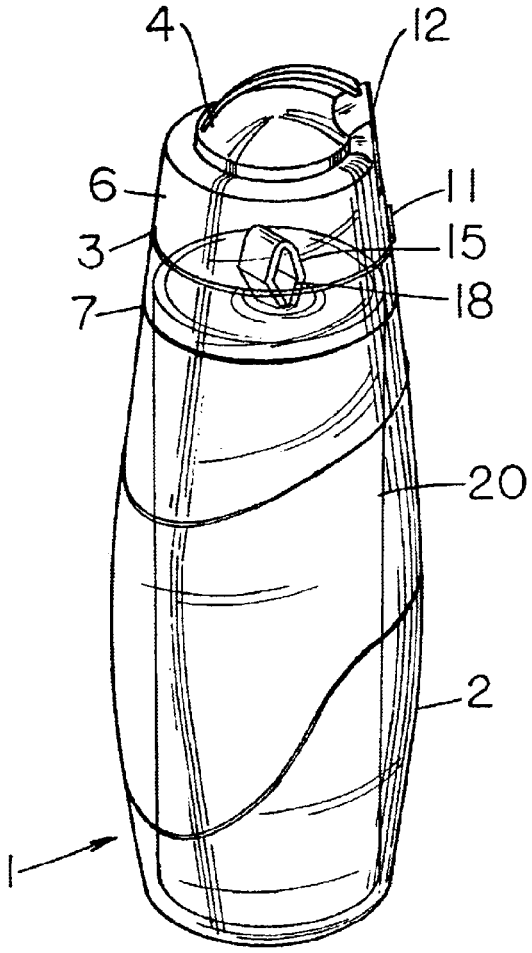
FIG. 8 is a front perspective view of the apparatus with the pre-moistened wipe pack fully engaged prior to the removal of the starter pin.

Referring to FIGS. 7 and 8 the dispenser 1 is shown in combination with the pre-moistened wipe pack 20 which includes the wipes 27, a solution, a color component and a packaging member 28. The pre-moistened wipe pack 20 is made up of a center pull continuous circular pack with perforated divisions at the end of each wipe 27. The wipes 27 are dispensed through the opening 22 in the upper portion 6 of the tip member 3. The protrusions 23 of the opening 22 allow for the wipes 27 to pass through the opening 20 but separate the wipes 27 at the point of perforation at the end of each wipe 27.

The pre-moistened wipe pack 20 also may contain a color component that acts as a color identification system for the dispenser. The color of the pre-moistened pack would correlate to a product to inform the end user what product is on the pre-moistened wipe pack 20 in the dispenser 1 at any time. The color component can be contained in the solution of the pre-moistened wipe pack 20 or it can be in the packaging member 28 of the pre-moistened wipe pack 20. Either method of introducing a color to the pre-moistened wipe pack 20 allows the identification of the product through the transparent portion 9 of the dispenser 1 by the end user. Further the color component being incorporated in the pre-moistened wipe pack 20 allows a single dispenser 1 to be used with multiple products.

Figure 6:
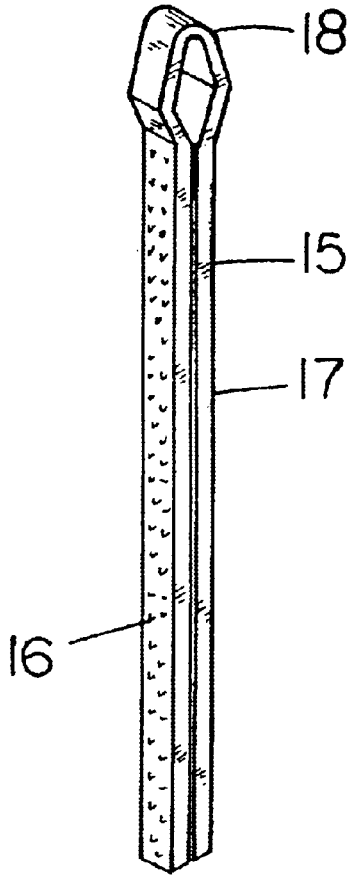
FIG. 6 is a front perspective view of the starter pin of the pre-moistened wipe packs.

The pre-moistened wipe pack 20 also contains a starter pin 15 which is used to engage the wipes with the opening 22 of the upper section 6 of the tip member 3. The starter pin 15 can also be used to re-start the wipes 27 if for some reason the wipes disengage with the opening 22 of the dispenser 1. As seen in FIG. 6 the starter pin 15 includes a handle portion 18 attached to a long shaft 17 that spans the length of the wipes 27 in the pre-moistened wipes pack 20. The starter pin 15 incorporates small protrusions 16 along the length of the shaft 17 in order to engage the wipes 27.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. An apparatus for dispensing pre-moistened wipes comprising:

a housing;

a two sectioned tip member for dispensing of the pre-moistened wipes the two sectioned tip member having a lower section connected to the housing and an upper section having;

a. a well b. an opening in the well c. a cover over the well and opening d. a self closing mechanism functionally attached to the cover;

a hinge member functionally connecting the upper section and the lower section of the tip member and a locking mechanism functionally attached to the upper and lower sections of the tip member.

2. The apparatus of claim 1 wherein the lower section of the two sectioned tip member is connected to the housing in a non-removable manner.

3. The apparatus of claim 1 wherein the self closing mechanism is engages the cover of the tip member.

4. The apparatus as defined in claim 1 wherein a portion of the housing is composed of a transparent material.

5. The apparatus as defined in claim 1 wherein the housing is made of a transparent material.

6. The apparatus as defined in claim 1 wherein the opening of the tip member is essentially circular with at least one protrusion extending towards the center of the opening.

7. The apparatus as defined in claim 1 wherein the self closing mechanism comprises:

a. an arm member;

b. a spring member;

c. an attachment member;

wherein the arm member is attached to the cap member and the attachment member is attached to the lower section of the tip member and the spring member engages the arm member and the attachment member simultaneously.

8. The dispenser of claim 1 wherein the housing has a connecting member for engaging a support member.

9. The dispenser of claim 8 wherein the connecting member is engaged with a bracket for securing the dispenser to a fixed surface.

10. The dispenser of claim 8 wherein the connecting member is engaged with a clip which is secured to a belt or waist band.

11. A dispensing apparatus and a pre-moistened wipes pack fully contained in the dispensing apparatus the dispensing apparatus having a transparent portion which may encompass no more than the entire dispenser where the pre-moistened wipe packs contain a color that correlates to a product on the wipes and can be seen through the transparent section of the housing.

12. An apparatus for dispensing pre-moistened wipes and pre-moistened wipes pack comprising: a housing; a two sectioned tip member for dispensing of the pre-moistened wipes the two sectioned tip member having a lower section connected to the housing and an upper section having;

a. a well;

b. an opening in the well;

c. a cover over the well and opening;

d. a self closing mechanism functionally attached to the cover;

a hinge member functionally connecting the upper section and the lower section of the tip member;

a locking mechanism functionally attached to the two sections of the tip member;

a pre-moistened wipes pack including:

a. a packaging member containing;

b. a color component;

c. wipes and d. a solution on said wipes.

13. The apparatus of claim 12 wherein the wipes are in a center pull continuous circular pack with perforated divisions at the end of each sheet.

14. The apparatus of claim 13 wherein a lower section of the two sectioned tip member is connected to the housing in a non-removable manner.

15. The apparatus of claim 14 wherein the self closing mechanism is attached to the cover of the tip member.

16. The apparatus as defined in claim 13 wherein the opening of the tip member is essentially circular with at least one protrusion extending towards the center of the opening.

17. The apparatus of claim 12 wherein the housing has a connecting member to attach said dispenser to supporting surfaces.

18. The apparatus as defined in claim 15 wherein the housing contains a portion which is composed of a transparent material.

19. The apparatus as defined in claim 15 wherein the housing is made of a transparent material.

20. The pre-moistened wipe pack as defined in claim 12 wherein color component has a varying color correlating to the solution contained in the pre-moistened wipes pack.

21. The pre-moistened wipe pack as defined in claim 19 wherein the color component is contained in the solution.

22. The pre-moistened wipe pack as defined in claim 19 wherein the color component is contained in the packaging member.

23. The pre-moistened wipe pack as defined in claims 13 wherein the pack contains a starter pin to engage the wipes with the opening of the tip member.

24. The starter pin of claim 22 wherein the pin has a handle portion attached to an elongated shaft that spans the length of the wipes in the pre-moistened wipes pack.

25. The starter pin of claim 23 wherein the pin has small protrusions that extend the entire length of the shaft.

* * * * *